United States Patent [19]

Lay

[11] Patent Number: 4,844,302

[45] Date of Patent: Jul. 4, 1989

[54] TWO-PART CLOSURE ASSEMBLY

[75] Inventor: George E. Lay, Shadyside, Ohio

[73] Assignee: Wheeling Stamping Company, Wheeling, W. Va.

[21] Appl. No.: 217,161

[22] Filed: Jul. 11, 1988

[51] Int. Cl.[4] ..... B65D 25/48

[52] U.S. Cl. ..... 222/568; 222/111; 222/542; 222/570; 141/381

[58] Field of Search ..... 222/539, 542, 566–568, 222/570, 109, 111; 220/85 SP; 215/228, DIG. 7; 141/381

[56] References Cited

U.S. PATENT DOCUMENTS

| | | | |
|---|---|---|---|
| 3,684,120 | 8/1972 | Beeman | 215/100 |
| 4,128,189 | 12/1978 | Baxter | 222/109 |
| 4,150,761 | 4/1979 | Collins | 215/228 |
| 4,273,247 | 6/1981 | Earls | 215/228 |
| 4,566,509 | 1/1986 | Szajna | 141/381 |
| 4,706,829 | 11/1987 | Li | 222/109 X |

*Primary Examiner*—Joseph J. Rolla
*Assistant Examiner*—Steven M. Reiss
*Attorney, Agent, or Firm*—Parmelee, Miller, Welsh & Kratz

[57] ABSTRACT

A two-part closure assembly for a container includes a spout and a measuring cup. The spout has an outer annular ring, a liquid-dispensing component disposed within an upper portion of the annular ring and a passageway therethrough adapted for fluid flow communication with a liquid held in the container. The annular ring has an inner surface which has an annular groove in the upper portion of the ring, an annular recess in the lower portion of the ring, and means in the lower portion to engage a container. The cup has a base, and a sidewall extending upwardly from the base to define a cavity into which a liquid can be poured. An annular flange, extending outwardly from the outer surface of the sidewall of the cup, is alternately releasably engageable within the annular groove in the inner surface of the annular ring of the spout to envelop the liquid-dispensing component of the spout and within the annular recess in the inner surface to be disposed within the liquid-dispensing component.

10 Claims, 2 Drawing Sheets

TWO-PART CLOSURE ASSEMBLY

BACKGROUND OF THE INVENTION

The invention relates to a two-part closure assembly for a container, and, more particularly, to such an assembly that includes a spout and a cup.

Several types of liquids, particularly liquid soaps and detergents, are packaged in containers that include a cup into which the liquid is poured from the container before use so that the user can conveniently determine the amount of the liquid that has been dispensed from the container. The liquid is commonly poured from a spout on the container to a cup, which may include measuring indicia. In order to prevent the cup from being separated from the container, the cup often is designed to be part of the closure assembly for the container, such as an overcap which overlies a cap while the container is not in use.

Various mechanisms have been used in such two-part closure assemblies to attach a cap and a cup in the form of an overcap. In U.S. Pat. No. 4,273,247, the cup includes a collar extending upwardly within the cup from its base to engage the cap. The cup and cap disclosed in U.S. Pat. No. 4,150,761 have complementarily ribbed surfaces so that the interior surface of the cup can engage the cap. In the cup and cap combination of U.S. Pat. No. 3,684,120, the inner surface of the cup contacts a lip projecting outwardly from the upper surface of the container neck as the cap is placed on the container. A cap overlies the cup and threadedly engages the container to seal the container. The cap may contain an annular projection on the inner surface of its base to prevent axial movement of the cup when the container is sealed.

Often some of the liquid remains in the cup after the liquid is poured therefrom for use. This excess liquid creates a mess when it drains from the cup over the outside of the container when the cup is inverted over the cap. Thus, a desired feature of two-part closure assemblies that include a measuring cup is that the seal between the cup and the cap or spout be leakproof to prevent the liquid from spilling from the container.

One proposed solution to the drainage of excess liquid from the cup is to design the cup so that the liquid drains back into the container, as in U.S. Pat. No. 4,566,509. The sidewall of the cup is disposed within the neck of the container when the closure unit is in place so that the excess liquid in the cup drains back into the container. An outwardly directed annular flange on the sidewall of the cup rests on a sealing surface at the upper edge of the container neck and is secured between the sealing surface and an annular flange on a ring member to hold the cup in place within the container when the container is sealed.

It is important in these latter types of closure assemblies that the cup be attached to the remainder of the closure assembly so that liquid can not leak from the container through the closure assembly, particularly if the container is accidentally knocked over or dropped.

SUMMARY OF THE INVENTION

The two-part closure assembly of the invention for a container includes a spout and a measuring cup.

The spout has an outer annular ring and a liquid-dispensing component disposed within an upper portion of the annular ring, and a passageway therethrough adapted for fluid flow communication with a liquid held in the container. The annular ring has an inner surface which has an annular groove in an upper portion of the ring, an annular recess in a lower portion of the ring, and means in the lower portion to engage a container.

The cup has a base and a sidewall extending upwardly from the base to define a cavity into which a liquid can be poured. An annular flange, extending outwardly from the outer surface of the sidewall of the cup is alternately releasably engageable within the annular groove in the inner surface of the annular ring of the spout to envelop the liquid-dispensing component of the spout, or held within the annular recess in the inner surface to be disposed within the liquid-dispensing component. The sea between the cup and the spout created when the flange is disposed within the annular groove or recess is tight so that liquid can not leak from the container when the closure assembly is properly in place. The cup is readily separated from, and reattached to, the spout for use by snapping the flange into the groove or holding the flange within the recess in the inner surface of the annular ring of the spout.

It is an object of the invention that the sidewall of the cup is disposed within the container when the cup is attached to the spout so that any excess liquid in the cup drains into the container.

It is another object of the invention that the closure assembly of the invention be easy and convenient to use.

It is still another object of the invention that the cup be readily separated from, and reattached to, the spout for use.

It is yet another object of the invention that the seal between the cup and the spout be tight so that liquid can not leak from the container when the closure assembly is properly in place.

DESCRIPTION OF THE DRAWINGS

Other objects and advantages of the present invention will become readily apparent upon reference to the following drawings wherein.

DETAILED DESCRIPTION OF THE PREFERRED EMBODIMENTS

The two-part closure assembly 1 of the invention (FIGS. 1–4) includes a spout 3 and a measuring cup 5. The cup 5 is designed to be inverted and secured to the spout 3.

Figure 5:
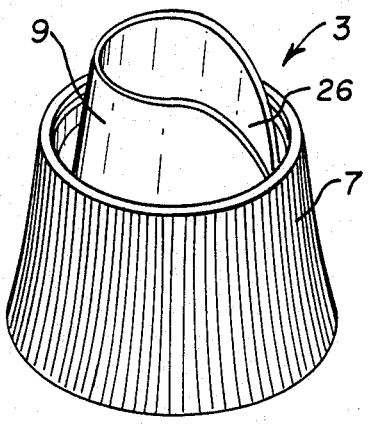
FIG. 5 is a perspective view of the spout of the closure assembly of FIG. 1.
Figure 6:
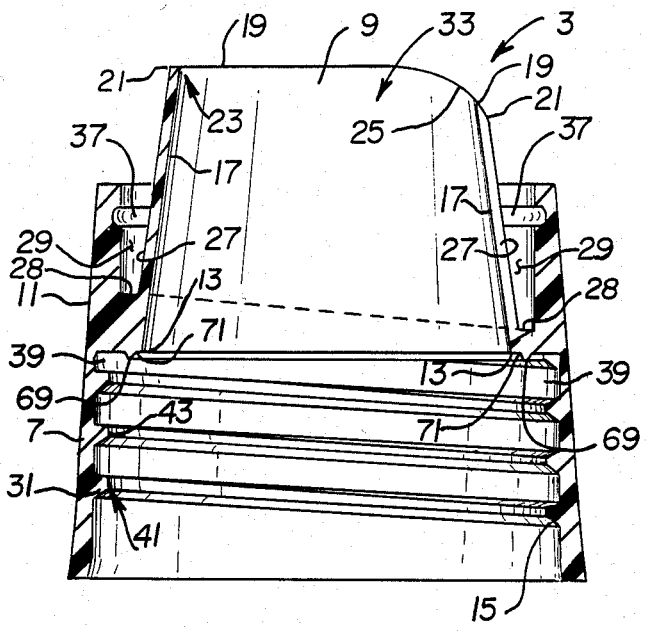
FIG. 6 is a cross-sectional view of the spout of FIG. 5.

The spout 3, illustrated in FIGS. 5 and 6, has an outer annular ring 7 and a liquid-dispensing component 9, which is disposed within the upper portion 11 of the annular ring 7. The liquid-dispensing component 9 is defined by an annular shoulder 13 projecting inwardly from the inner surface 15 of the annular ring 7 and an annular sidewall 17 extending upwardly from the shoulder 13. The upper edge 19 of the sidewall 17 defines a pouring edge 21 at a pouring portion 23 of the spout 3. The height of the sidewall 17 gradually decreases from the pouring portion 23 of the spout 3 to the opposite side 25 of the spout 3. The opposite side 25 of the spout 3 includes a vertical slit 26 which extends from the upper edge 19 of the sidewall 17 to the shoulder 13. The upper surface 78 of the shoulder 13 slopes at an approximately 5° angle from the pouring portion 23 to the opposite side 25 (FIG. 6). The inner surface 15 of the annular ring 7, the shoulder 13 and the outer surface 27 of the sidewall 17 define an annular gap 29.

The sidewall 17 and the inner surface 15 of the lower portion 31 of the annular ring 7 of the spout 3 define a passageway 33 through the spout 3 that is adapted for fluid flow communication with the liquid that is held within the container 35. The liquid is poured from the container 35 by tilting the container 35 until the liquid in the container 35 flows from the container 35 through the passageway 33, over the pouring edge 21 of the pouring portion 23 of the spout 3 of the liquid-dispensing component 9 and out of the spout 3.

Any excess liquid trapped within the annular gap 29 between the annular ring 7 and the annular sidewall 17 will drain back into the container 35. The liquid flows along the upper surface 28 of the shoulder 13 from the higher side at the pouring portion 23 to the lower side at the opposite side 25 and through the vertical slit 26 to the passageway 33 and container 35.

The inner surface 15 of the annular ring 7 includes an annular groove 37 in the upper portion 11 of the ring 7 above the shoulder 13 and a recess 39 just below the shoulder 13 in the lower portion 31 of the ring 7. The inner surface 15 of the lower portion 31 of the annular ring 7 includes means 41 to engage the container 35. Preferably, the inner surface 15 of the lower portion 31 of the ring 7 is a threaded surface 43 and the container 35 includes a complementary threaded outer surface 45 at the pour opening 46 thereof. The recess 39 is located at the top edge of the threaded surface 43 of the ring 7, and is defined by the uppermost edge of the threaded surface 43.

Figure 7:
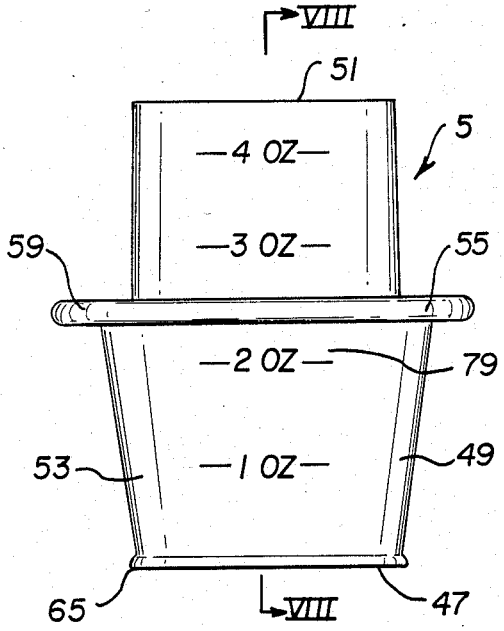
FIG. 7 is a front elevational view of the cup of the closure assembly of FIG. 1.
Figure 8:
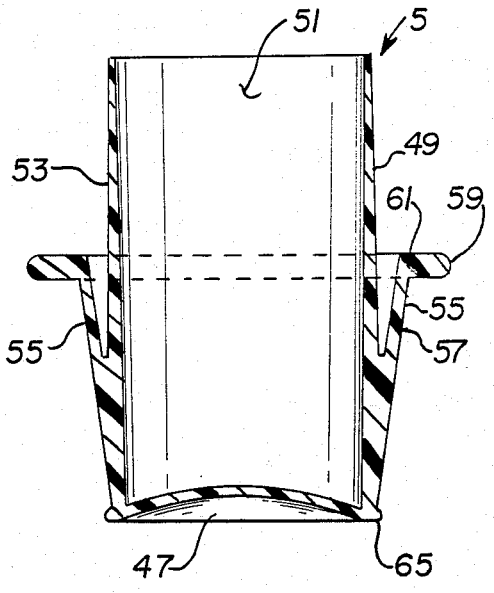
FIG. 8 is a cross-sectional view of the cup of FIG. 7 taken along line VIII—VIII of FIG. 7.

The cup 5, illustrated in FIGS. 7 and 8, includes a base 47 and sidewall 49 extending upwardly from the base 47 to define a cavity 51 into which a liquid can be poured. The outer surface 53 of the sidewall 49 of the cup 5 supports an outwardly directed annular flange 55. The flange 55 preferably includes an annular projection 57 and a foot 59 extending generally laterally from the free end 61 of the projection 57. Preferably, the projection 57 extends outwardly from the outer surface 53 of the sidewall 49 of the cup 5 at an acute angle. The flange 55, preferably the foot 59 of the flange 55, is either releasably engageable within the annular groove 37 or held within the recess 39 in the inner surface 15 of the annular ring 7 of the spout 3 between the shoulder 13 and the container 35. In either position, the placement of the flange 55 within the groove 37 or recess 39 provides an effective seal between the cup 5 and the spout 3, so that liquid from the container 35 can not leak from the container 35 if the container 35 is accidentally knocked over or dropped.

Figure 1:
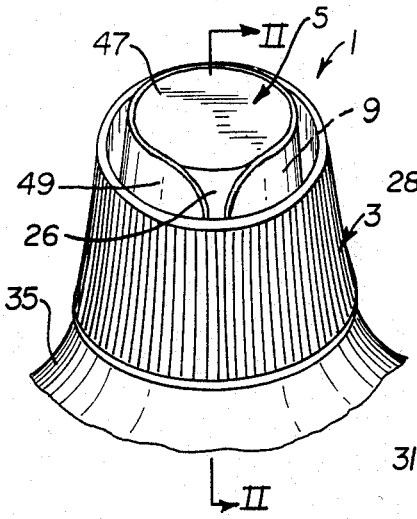
FIG. 1 is a perspective view of the closure assembly of the invention illustrating the cup as engaged within the lower of the annular grooves in the inner surface of the ring of the spout.
Figure 2:
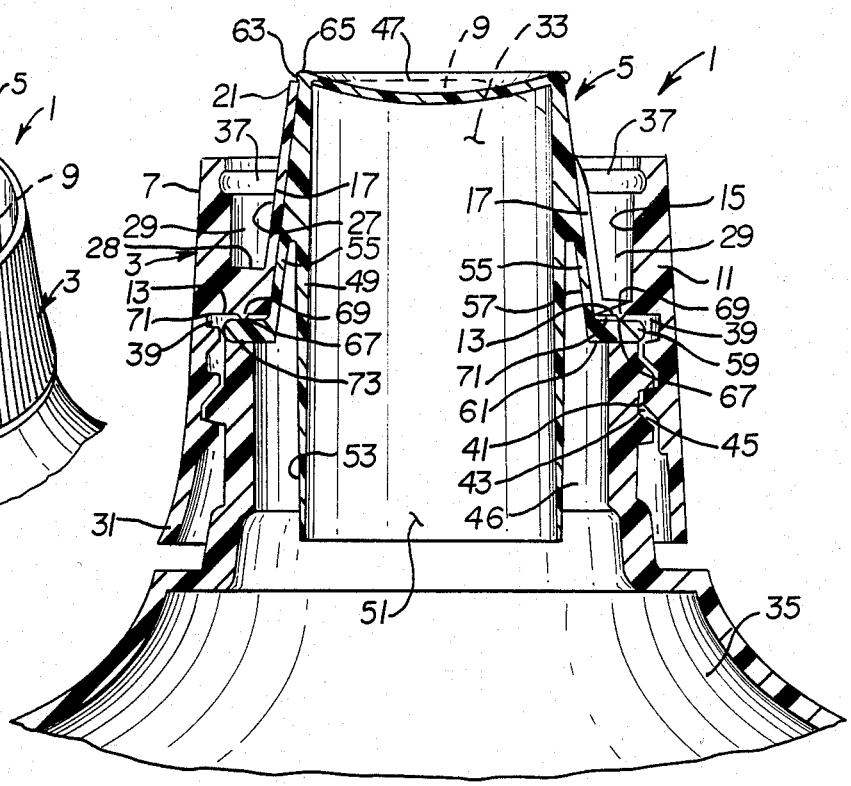
FIG. 2 is a cross-sectional view of the closure assembly of the invention taken along the line II—II of FIG. 1.

When the flange 55 is held within the recess 39, as illustrated in FIGS. 1 and 2, the cup 5 is axially disposed upwardly through the passageway 33 of the spout 3. A snap-lock 63 is formed between a rim 65 on the base 47 of the cup 5 and the pouring edge 21 of the sidewall 17 of the spout 3 to help secure the cup 5 to the spout 3. The rim 65 of the base 47 of the cup 5 forms a lip under which the pouring edge 21 of the sidewall 17 of the spout 3 snaps to form the snap-lock 63. Because the height of the sidewall 17 of the spout 3 decreases from the pouring portion 23 of the spout 3 to the opposite side 25 of the spout 3, the snap-lock 63 forms through approximately one half to two-thirds of the circumference of the spout 3. A seal 67 is provided between the foot 59 of the flange 55 and an annular bulge 69 projecting from the lower surface 71 of the shoulder 13. The seal 67 is formed as the threaded surface 43 of the lower portion 31 of the annular ring 7 is tightened against the complementarily threaded surface 45 of the container 35 so that the foot 59 of the flange 55 is wedged between the upper edge 73 of the container 35 and the lower surface 71 of the shoulder 13.

Figure 3:
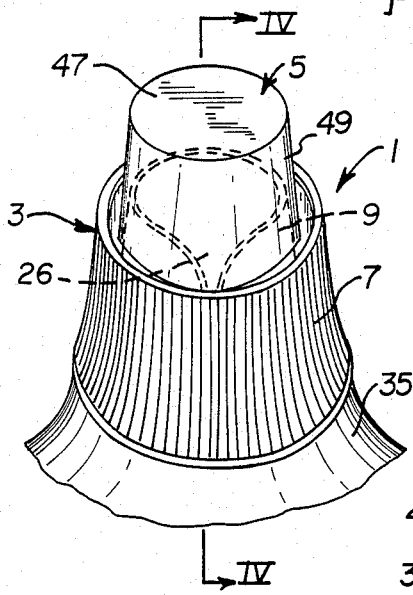
FIG. 3 is a perspective view of the closure assembly of FIG. 1 illustrating the cup as engaged within the upper of the annular grooves in the inner surface of the ring of the spout.
Figure 4:
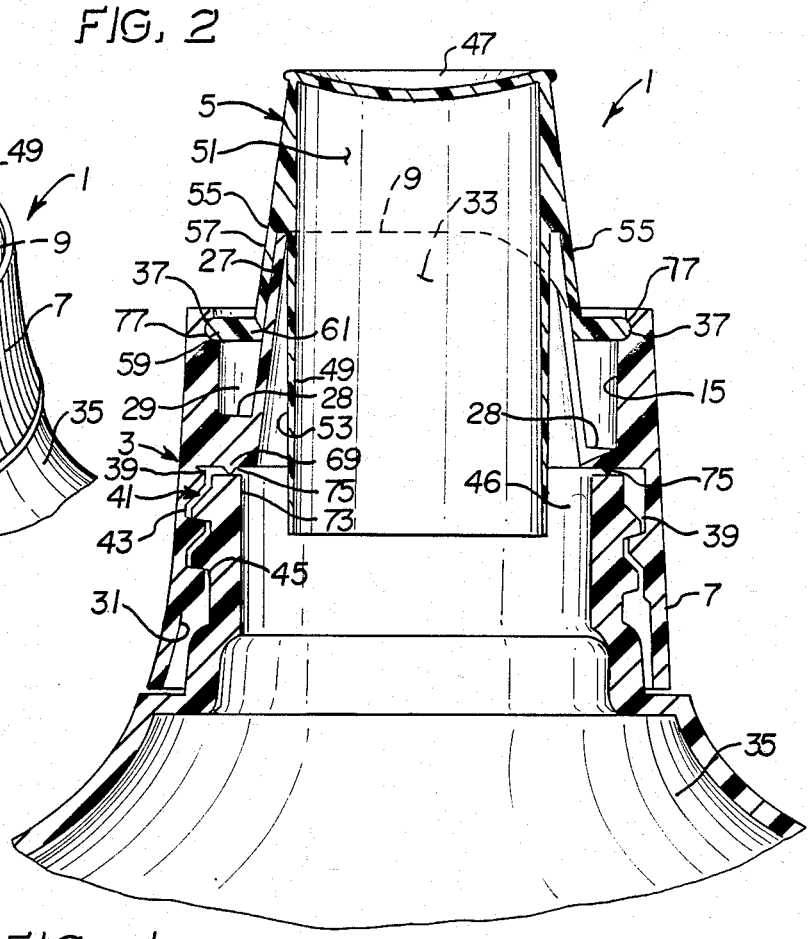
FIG. 4 is a cross-sectional view of the closure assembly of FIG. 1 taken along the line IV—IV of FIG. 3.

When the flange 55 is releasably engaged within the groove 37, as illustrated in FIGS. 3 and 4, the cup 5 envelops the liquid-dispensing component 9 of the spout 3 and the flange 55 of the cup 5 is disposed within the annular gap 29. A first seal 75 is provided between the upper edge 73 of the container 35 and the annular bulge 69. A second seal 77 is provided between the foot 59 of the flange 55 and the groove 37.

The sidewall 49 of the cup 5 may include measuring indicia 79 (FIG. 7) so that a user can conveniently determine how much liquid has been poured from the container 35.

The closure assembly 1 of the invention is particularly useful for a container 35 for a liquid, such as a liquid soap or detergent. The closure assembly 1 is designed for the container 35 to be packaged with the flange 55 of the cup 5 held within the recess 39 of the spout 3 (FIG. 1). The user then removes the closure assembly 1 from the container 35 by unscrewing the closure assembly 1 with respect to the container 35. The cup 5 can then be separated from the spout 3 by gently pushing the cup 5 downwardly through the passageway 33 of the spout 3. The outer diameter of the foot 59 of the flange 55 is such that the foot 59 of the cup 5 can clear the threaded surface 43 of the lower portion 31 of the annular ring 7 to facilitate separation of the cup 5 from the spout 3. The spout 3 is then replaced on the container 35. The user is then able to dispense liquid from the container 35 through the spout 3 into the cup 5 in order to provide a measured supply of liquid for use.

After the cup 5 is used, and after each succeeding use, the cup 5 is inverted to place the base 47 uppermost, and replaced within the closure assembly 1 by snapping the flange 55 into place within the groove 37 of the inner surface 15 of the annular ring 7 of the spout 3 (FIG. 3). In order to separate the cup 5 from the spout 3 for each succeeding use, the cup 5 is grasped between the thumb and forefinger, and tilted to the side to release the flange 55 from the groove 37 so that the cup 5 can then be pulled from the spout 3. The spout 3 does not need to be removed from the container 35 in order to pour liquid from the container 35.

The closure assembly 1 can be assembled at the plant and shipped to the customer as a single unit. The snap-lock 63 keeps the cup 5 and spout 3 in place with the flange 55 of the cup held within the recess 39 of the spout 3 during shipping. The customer can then apply the closure assembly 1, to their containers in a single step. Heretofore, the customer had to apply most closure assemblies to their containers in a two-step process.

The closure assembly 1 of the invention is easy and convenient to use. Because the sidewall 49 of the cup 5 is disposed within the container 35 when the cup 5 is attached to the spout 3 of the closure assembly 1 of the invention, any excess liquid in the cup 5 drains into the container 35.

Further, the seal between the cup 5 and the spout 3 is tight so that liquid can not leak from the container 35 when the closure assembly 1 is properly in place. In addition, the cup 5 is readily separated from, and reattached to, the spout 3 for use.

What is claimed is:

1. A two-part closure assembly for a container comprising:

a spout having an outer annular ring, a liquid dispensing component, and a passageway therethrough adapted for fluid flow communication with a liquid held in a said container, said annular ring of said spout having an upper portion, a lower portion and an inner surface, said inner surface of said annular ring having an annular groove in said upper porton of said annular ring, an annular recess in said lower portion of said ring and means in said lower portion to engage a said container, said liquid-dispensing component of said spout being disposed within said upper portion of said annular ring; and a measuring cup, said measuring cup having a base, a sidewall extending upwardly from said base to define a cavity into which a liquid can be poured, said sidewall having an outer surface, and an annular flange extending outwardly from said outer surface of said sidewall of said measuring cup, said flange being alternately releasably engageable within said annular groove in said inner surface of said annular ring of said spout to envelop said liquid-dispensing component of said spout or held within said annular recess in said inner surface to be disposed within said liquid-dispensing component.

2. The closure assembly of claim 1 in which said flange includes a projection extending outwardly from said outer surface of said cup, said projection having a free end and a foot extending generally laterally from said free end of said projection

3. The closure assembly of claim 2 wherein said projection extends from said outer surface of said cup at an acute angle.

4. The closure assembly of claim 1 in which said liquid-dispensing portion of said spout is defined by an annular shoulder projecting inwardly from said inner surface of said annular ring of said spout and an annular sidewall extending upwardly from said shoulder.

5. A two-part closure assembly for a container comprising:

a spout having an outer annular ring, a liquid-dispensing component, and a passageway therethrough adapted for fluid flow communication with a liquid held in a said container, said annular ring of said spout having an upper portion, a lower portion and an inner surface, said inner surface of said annular ring having an annular groove in said upper portion of said annular ring, an annular recess in said lower portion of said ring, and means in said lower portion to engage a container, said liquid-dispensing component of said spout being disposed within said upper portion of said annular ring and being defined by an annular shoulder projecting inwardly from said inner surface of said annular ring of said spout and an annular sidewall extending upwardly from said shoulder; and a measuring cup, said measuring cup having a base, a sidewall extending upwardly from said base to define a cavity into which a liquid can be poured, said sidewall having an outer surface, and an annular flange extending outwardly from said outer surface of said sidewall of said measuring cup at an acute angle, said flange including a projection having a free end and a foot extending generally laterally from said free end of said projection, said flange being alternately releasably engageable within said annular groove in said inner surface of said annular ring of said spout to envelop said liquid-dispensing component of said spout and within said annular recess in said inner surface to be disposed within said liquid-dispensing component.

6. A container and two-part closure assembly comprising:

a container having a pour opening;

a spout having an outer annular ring, a liquid dispensing component, and a passageway therethrough adapted for fluid flow communication with a liquid held in said container, said annular ring of said spout having an upper portion, a lower portion and an inner surface, said inner surface of said annular ring having an annular groove in said upper portion of said annular ring, an annular recess in said lower portion of said ring, and means in said lower portion to engage said container about said pour opening, said liquid-dispensing component of said spout being disposed within an upper portion of said annular ring; and a measuring cup, said measuring cup having a base, a sidewall extending upwardly from said base to define a cavity into which a liquid can be poured, said sidewall having an outer surface, and an annular flange extending outwardly from said outer surface of said sidewall of said measuring cup, said flange being alternately releasably engageable within said annular groove in said inner surface of said annular ring of said spout to envelop said liquid-dispensing component of said spout and within said annular recess in said inner surface to be disposed within said liquid-dispensing component.

7. The container and closure assembly of claim 6 in which said container and said lower portion of said annular ring of said spout have complementarily threaded surfaces by which said spout can be attached to said container.

8. The container and closure assembly of claim 7 in which said flange includes a projection extending outwardly from said outer surface of said cup, said projection having a free end and a foot extending generally laterally from said free end of said projection.

9. The container and closure assembly of claim 8 wherein said projection extends from said outer surface of said cup at an acute angle.

10. The container and closure assembly of claim 6 in which said liquid-dispensing portion of said spout is defined by an annular shoulder projecting inwardly from said inner surface of said annular ring of said spout and an annular sidewall extending upwardly from said shoulder.

* * * * *